US010916840B2

(12) United States Patent
Hsu et al.

(10) Patent No.: US 10,916,840 B2
(45) Date of Patent: Feb. 9, 2021

(54) ELECTRONIC DEVICE WITH MULTI-PIECE ANTENNA STRUCTURE FOR INCREASED STRENGTH AND CONNECTION STABILITY

(71) Applicant: Chiun Mai Communication Systems, Inc., New Taipei (TW)

(72) Inventors: Liao-Yuan Hsu, New Taipei (TW); Kuo-Heng Sun, New Taipei (TW); Pao-Ching Mao, New Taipei (TW); Yen-Wei Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 16/424,859

(22) Filed: May 29, 2019

(65) Prior Publication Data

US 2019/0372211 A1 Dec. 5, 2019

(30) Foreign Application Priority Data

May 29, 2018 (CN) ..... 2018 1 0534171

(51) Int. Cl.
*H01Q 1/50* (2006.01)
*H01Q 1/24* (2006.01)
*H01Q 1/36* (2006.01)

(52) U.S. Cl.
CPC ..... *H01Q 1/50* (2013.01); *H01Q 1/242* (2013.01); *H01Q 1/36* (2013.01)

(58) Field of Classification Search
CPC .. H01Q 1/22; H01Q 1/48; H01Q 1/50; H01Q 1/242; H01Q 1/233; H01Q 1/243; H01Q 1/36; H01Q 9/0421
See application file for complete search history.

(56) References Cited

U.S. PATENT DOCUMENTS

| | | | | |
|---|---|---|---|---|
| 10,306,029 | B1 * | 5/2019 | Hwang | H04M 1/026 |
| 2009/0067141 | A1 * | 3/2009 | Dabov | H01Q 1/42 361/753 |
| 2016/0149289 | A1 * | 5/2016 | Lilja | H01Q 1/526 343/789 |
| 2019/0159355 | A1 * | 5/2019 | Baek | H04M 1/026 |

FOREIGN PATENT DOCUMENTS

| | | | |
|---|---|---|---|
| CN | 103022647 | A | 4/2013 |
| CN | 107087364 | A | 8/2017 |
| CN | 108039561 | A | 5/2018 |
| TW | 201507574 | A | 2/2015 |

* cited by examiner

*Primary Examiner* — Seokjin Kim
(74) *Attorney, Agent, or Firm* — ScienBiziP, P.C.

(57) ABSTRACT

An electronic device which is simple to manufacture includes a carrier frame and an outer frame. The carrier frame and the outer frame are both made of metal. The carrier frame serves as a ground terminal. A portion of the outer frame serves as an antenna of the electronic device. The antenna includes a feeding portion and a grounding portion. The feeding portion connects to a feed source. The grounding portion is attached to the carrier frame, and it is fixed to the carrier frame by welding process.

10 Claims, 5 Drawing Sheets

ELECTRONIC DEVICE WITH MULTI-PIECE ANTENNA STRUCTURE FOR INCREASED STRENGTH AND CONNECTION STABILITY

FIELD

The disclosure generally relates to an electronic device.

BACKGROUND

Antenna structure of a mobile electronic device and a carrier frame of the antenna structure are usually a one-piece structure. However, the one-piece structure needs a CNC (Computer Numerical Control) operation to be manufactured, which has a complicated process and high cost. There is room for improvement.

BRIEF DESCRIPTION OF THE DRAWINGS

Implementations of the present disclosure will now be described, by way of example only, with reference to the attached figures.

DETAILED DESCRIPTION

Figure 1:
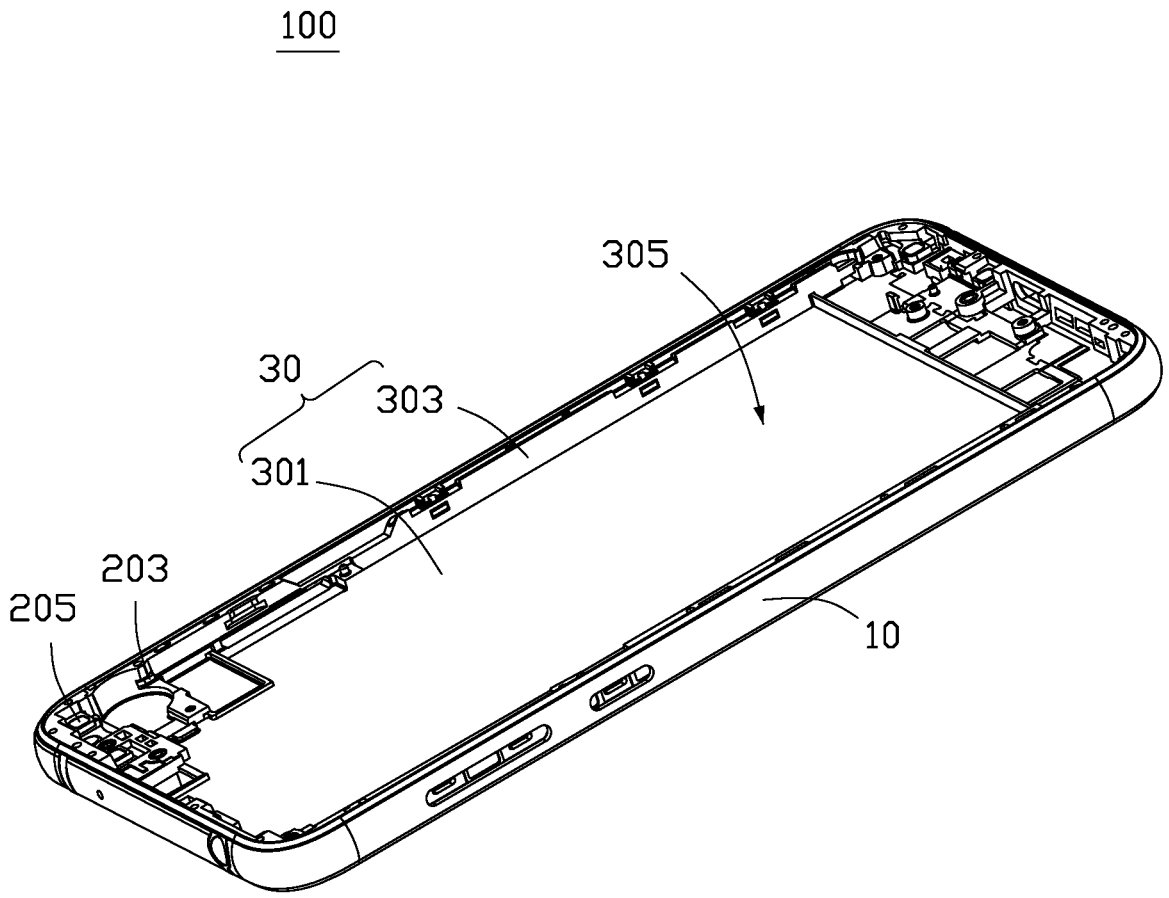
FIG. 1 is a perspective view of an exemplary embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiment described herein can be practiced without these specific details. In other instances, methods, procedures, and components have not been described in detail so as not to obscure the related relevant feature being described. Further, the description is not to be considered as limiting the scope of the embodiments described herein. The drawings are not necessarily to scale and the proportions of certain parts may be exaggerated to better illustrate details and features of the present disclosure.

The term "comprising" when utilized, means "include, but is not limited to"; it specifically indicates open-ended inclusion or membership in the so-described combination, group, series and the like. The term "coupled" when utilized, means "either a direct electrical connection between the things that are connected, or an indirect connection through one or more passive or active intermediary devices, but is not limited to".

FIG. 1 illustrates an electronic device 100. The electronic device 100 can be, but is not limited to, a mobile phone, a tablet computer, or the like. In the present embodiment, the electronic device 100 is a mobile phone.

The electronic device 100 includes an outer frame 10 and a carrier frame 30. The outer frame 10 and the carrier frame 30 are both made of metal. The metal can be, but is not limited to, aluminum, aluminum alloy, aluminum-magnesium alloy, magnesium alloy, stainless steel, titanium, titanium alloy, and the combinations thereof.

The outer frame 10 is positioned on the carrier frame 30. In the present embodiment, the outer frame 10 has a rectangular structure. The outer frame 10 is manufactured by at least a CNC (Computer Numerical Control) process.

Figure 2:
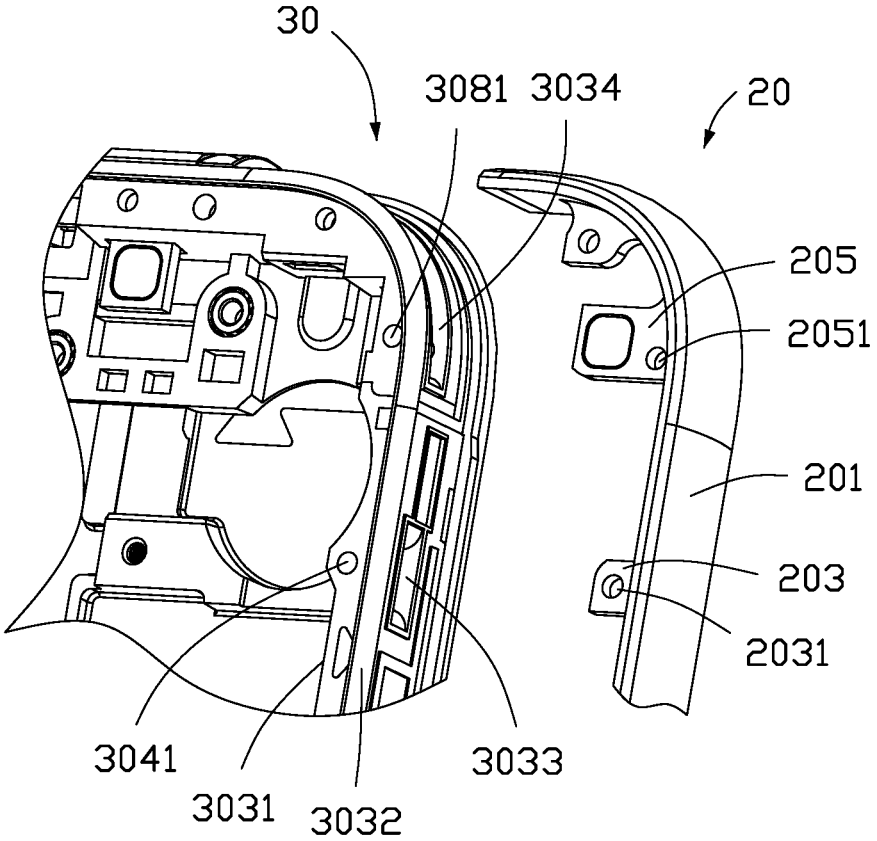
FIG. 2 is an exploded view of a portion of the electronic device in FIG. 1.

Referring to FIG. 2, in the present embodiment, at least a portion of the outer frame 10 is an antenna 20 of the electronic device 100.

The antenna 20 includes a body 201, a grounding portion 203, and a feeding portion 205.

The body 201 is a portion of the outer frame 10. The body 201 is air-isolated from the carrier frame 30.

In the present embodiment, the grounding portion 203 and the feeding portion 205 are on the same surface of the body 201. The feeding portion 205 and the grounding portion 203 are spaced apart from each other and protrude from the body 201.

The grounding portion 203 is configured to ground the antenna 20. The grounding portion 203 connects to the carrier frame 30. In the present embodiment, the carrier frame 30 is a ground terminal of the antenna 20, and the grounding portion 203 is electrically connected to the carrier frame 30. The grounding portion 203 grounds the antenna 20 through the carrier frame 30.

Figure 3:
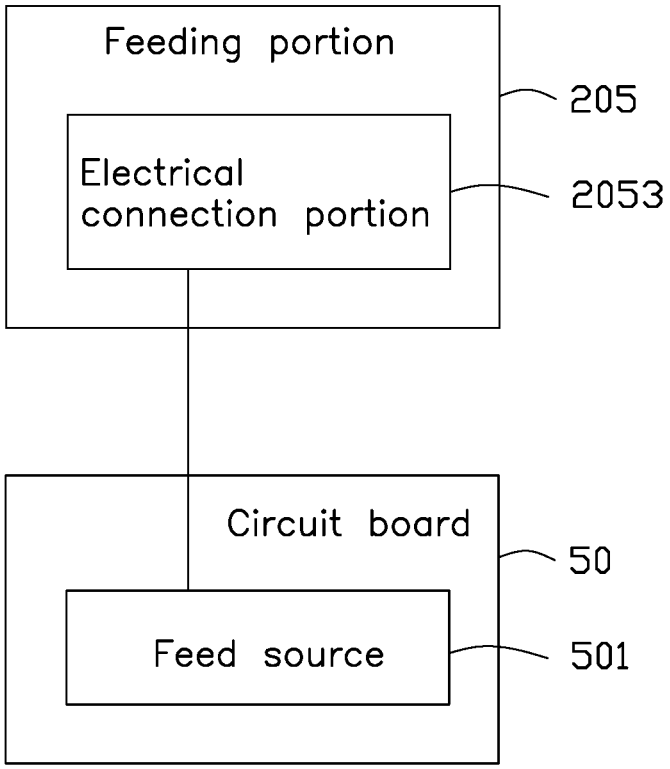
FIG. 3 is a block diagram of a portion of an antenna structure in the device in FIG. 1.

Referring to FIG. 2 and FIG. 3, the feeding portion 205 is configured to connect the antenna 20 to a feed source 501. The feeding portion 205 is provided with an electrical connection portion 2053, such as a pin, a terminal, or a spring. The electrical connection portion 2053 is connected to the feed source 501 on a circuit board 50 of the electronic device 100 through a spring piece, a wire, or a screw. The feed source 501 provides signal to the antenna 20.

In the present embodiment, the carrier frame 30 is a middle frame of the electronic device 100 for carrying various electronic components, providing electromagnetic shielding, and strengthening structure of the electronic device 100. The electronic component is a display screen, a battery, a circuit board, and others. The carrier frame 30 is manufactured by at least a metal stamping process.

Referring to FIG. 1, the carrier frame 30 includes a bottom plate 301 and a side edge 303. The side edge 303 is on a periphery of the bottom plate 301 to form an accommodating portion 305 together with the bottom plate 301. The accommodating portion 305 is configured to receive the electronic components of the electronic device 100. The electronic component such as a display screen, a battery, or a circuit board.

Referring to FIG. 1 and FIG. 2, the side edge 303 includes a first surface 3031 and a second surface 3032. The first surface 3031 and the second surface 3032 are on opposite sides of the side edge 303. The first surface 3031 is adjacent to the bottom plate 301.

The side edge 303 further includes a first slot 3033. The first slot 3033 matches with the grounding portion 203. When the grounding portion 203 passes through the first slot 3033, the grounding portion 203 is exposed on the first surface 3031.

The side edge 303 further includes at least one protrusion 307. The at least one protrusion 307 is positioned on one side of the first slot 3033 for electrically connecting the grounding portion 203, so that the grounding portion 203 of the antenna 20 is grounded through the carrier frame 30.

Figure 4:
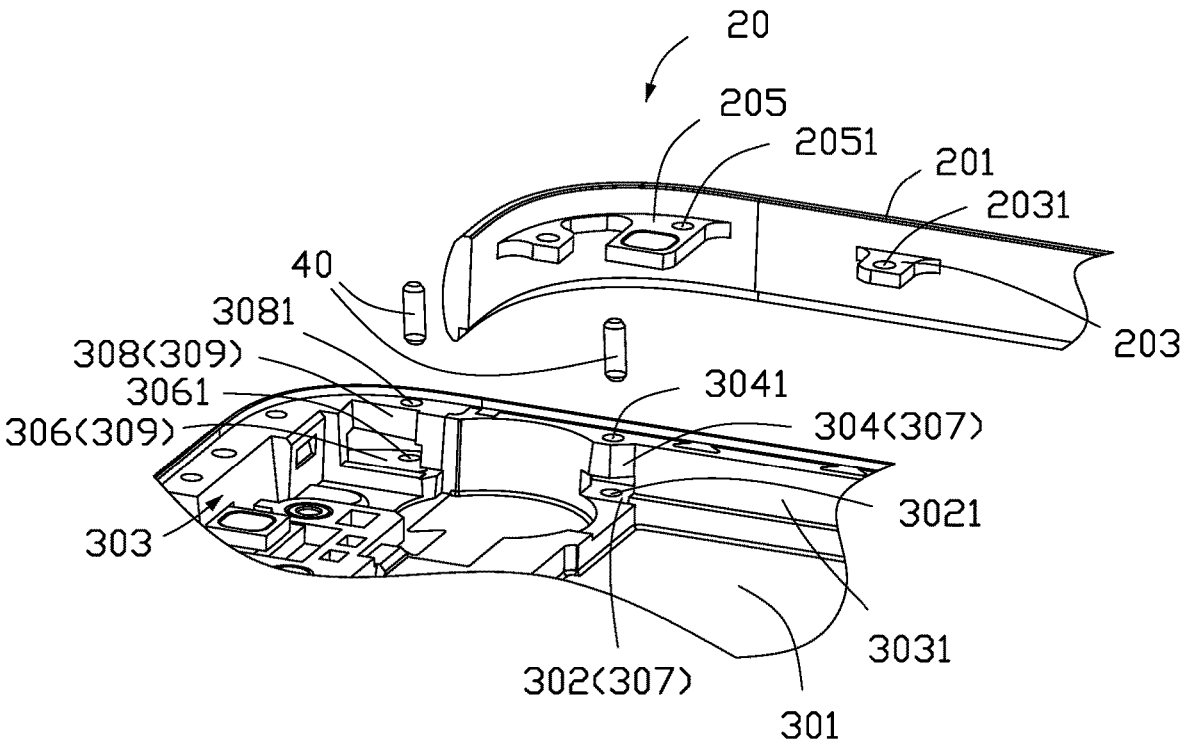
FIG. 4 is an exploded view of the portion of the electronic device in FIG. 1 from another perspective.
Figure 5:
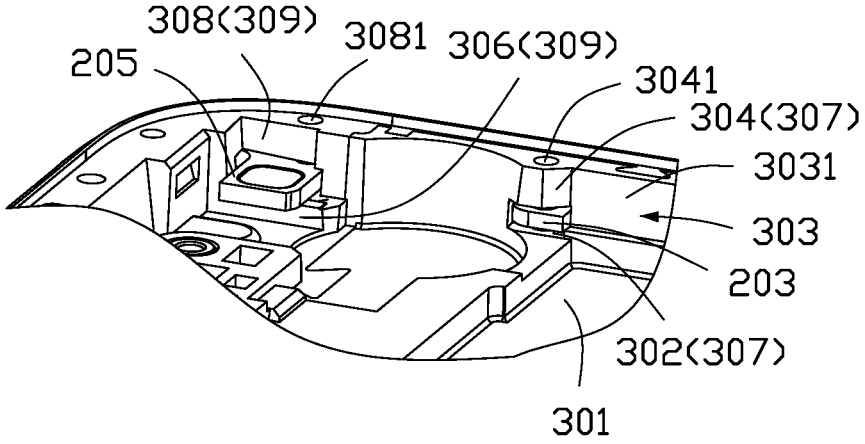
FIG. 5 is a perspective view of the portion of the electronic device in FIG. 1.

Referring to FIG. 4 and FIG. 5, in the present embodiment, the side edge 303 includes two protrusions 307, namely, a first protrusion 302 and a second protrusion 304. The first protrusion 302 and the second protrusion 304 are both formed by the first surface 3031 extending away from the second surface 3032. The first protrusion 302 and the second protrusion 304 are spaced apart from each other. The first protrusion 302 and the second protrusion 304 are at two sides of the first slot 3033. The first protrusion 302 is located at a junction of the first surface 3031 and the bottom plate 301.

When the grounding portion 203 passes through the first slot 3033, the grounding portion 203 is exposed on the first surface 3031 and is located between the first protrusion 302 and the second protrusion 304. The grounding portion 203 is in contact with the first protrusion 302 and the second protrusion 304, so that the antenna 20 is grounded.

Further, in order to enhance stability of the antenna 20, at least one of the first protrusion 302 and the second protrusion 304 is also fixedly connected to the grounding portion 203. In one embodiment, a junction of the grounding portion 203 and the first protrusion 302, and a junction of the grounding portion 203 and the second protrusion 304 are connected by laser spot welding, such that the grounding portion 203 connects to the first protrusion 302 and the second protrusion 304 on the side edge 303. In the present embodiment, the antenna 20 and the carrier frame 30 are both made of metal. Thus, the metal at the junction of the grounding portion 203 and the first protrusion 302, and the metal at the junction of the grounding portion 203 and the second protrusion 304 are fused together due to the high temperature of the welding process, so that the grounding portion 203, the first protrusion 302, and the second protrusion 304 are tightly coupled. Stability of the electrical connection and strength of the mechanical connection between the antenna 20 and the carrier frame 30 are both improved.

Further, the first protrusion 302 includes a first recessed hole 3021. The second protrusion 304 includes a first through hole 3041 which faces the first recessed hole 3021. Correspondingly, the grounding portion 203 includes a first hole 2031. The first hole 2031 is positioned on a side of the grounding portion 203 near the body 201. The first hole 2031 extends through the grounding portion 203. As such, when the grounding portion 203 passes through the first slot 3033, the grounding portion 203 is between the first protrusion 302 and the second protrusion 304. Moreover, when the first through hole 3041, the first hole 2031, and the first recessed hole 3021 are in air communication with each other and are aligned along a common axis, a mounting member 40 can pass through the first through hole 3041, the first hole 2031, and the first recessed hole 3021 to firmly fix the antenna 20 to the carrier frame 30. The mounting member 40 can be a fixing pin, a screw, or the like.

In order to ensure the connection quality of the grounding portion 203, the first protrusion 302, and the second protrusion 304, the antenna 20 can be initially fixed to the carrier frame 30 by the mounting member 40.

The side edge 303 further includes a second slot 3034 as shown in FIG. 2. The second slot 3034 cooperates with the feeding portion 205. When the feeding portion 205 passes through the second slot 3034, the feeding portion 205 is exposed on the first surface 3031. The feeding portion 205 is air-isolated from the side edge 303.

To firmly fix the antenna 20 to the carrier frame 30, the side edge 303 further includes at least one fixing portion 309 for facilitating the connection of the antenna 20 to the carrier frame 30. In the present embodiment, the side edge 303 includes two fixing portion 309, namely, a first fixing portion 306 and a second fixing portion 308 as shown in FIG. 4 and FIG. 5. The first fixing portion 306 and the second fixing portion 308 are both formed by the first surface 3031 extending away from the second surface 3032. The first fixing portion 306 and the second fixing portion 308 are spaced apart from each other. The first fixing portion 306 and the second fixing portion 308 are at two sides of the second slot 3034, for example, as shown in FIG. 2 and FIG. 4. The first fixing portion 306 is located at a junction of the first surface 3031 and the bottom plate 301.

Referring to FIG. 4, the first fixing portion 306 includes a second recessed hole 3061. The second fixing portion 308 includes a second through hole 3081 facing the second recessed hole 3061. Correspondingly, the feeding portion 205 includes a second hole 2051. The second hole 2051 is positioned on a side of the feeding portion 205 near the body 201. The second hole 2051 extends through the feeding portion 205. As such, when the feeding portion 205 passes through the second slot 3034, and the feeding portion 205 is between the first fixing portion 306 and the second fixing portion 308, for example, as shown in FIG. 5. The second through hole 3081, the second through hole 2051 and the second recessed hole 3061 are in air communication with each other and are aligned along a common axis, a mounting member 40 can pass through the second through hole 3081, the second hole 2051, and the second recess 3061 to fix the antenna 20 to the carrier frame 30.

The grounding portion 203 and the carrier frame 30 are connected by welding process such that the antenna 20 is grounded through the grounding portion 203, the antenna 20 is fixed on the electronic device 100, and the stability of the antenna 20 is enhanced. In addition, the outer frame 10 and the carrier frame 30 can be processed separately and in different ways, which simplifies the manufacturing process of the electronic device 100 and reduces the production cost. For example, the carrier frame 30 can be manufactured by metal stamping process. Structure of electronic device 100 disclosed is simpler than a one-piece structure of frame and carrier being formed by CNC process.

It is to be understood, however, that even through numerous characteristics and advantages of the present disclosure have been set forth in the foregoing description, together with details of assembly and function, the disclosure is illustrative only, and changes may be made in details, especially in the matters of shape, size, and arrangement of parts within the principles of the disclosure to the full extent indicated by the broad general meaning of the terms in which the appended claims are expressed.

What is claimed is:

1. An electronic device, comprising:

a carrier frame, wherein the carrier frame is made of metal, the carrier frame is a ground terminal;

an outer frame, wherein the outer frame is made of metal, at least a portion of outer frame is an antenna of the electronic device, the antenna includes a feeding portion and a grounding portion, the feeding portion connects to a feed source, the grounding portion electrically connects and fixes to the carrier frame by welding process;

wherein carrier frame defines a first slot, the grounding portion passes through and protrudes from the first slot, and a portion of the grounding portion which protrudes from the first slot is welded to the carrier frame.

2. The electronic device of claim 1, wherein the carrier frame is a middle frame of the electronic device and provides element supporting, electronic components carrying, electromagnetic shielding, and strengthening structure of the electronic device.

3. The electronic device of claim 1, wherein the carrier frame defines a second slot, and the feeding portion passes through and protrudes from the second slot.

4. The electronic device of claim 1, wherein the carrier frame comprises at least one protrusion, and the at least one protrusion is on one side of the first slot and electrically connects to the grounding portion.

5. The electronic device of claim 1, wherein the carrier frame comprises a first protrusion and a second protrusion, the first protrusion and the second protrusion are at two sides of the first slot, the grounding portion is between the first protrusion and the second protrusion, a junction of the grounding portion and the first protrusion and a junction of the grounding portion and the second protrusion are connected by welding process, such that the grounding portion connects to the first protrusion and the second protrusion.

6. The electronic device of claim 1, wherein the feeding portion electrically connects to the feed source, and the feed source provides a signal to the antenna.

7. The electronic device of claim 5, wherein the electronic device further comprises a mounting member, the grounding portion comprises a first hole, the first hole extends through the grounding portion, the first protrusion comprises a first recessed hole, the second protrusion comprises a first through hole which faces the first recessed hole, when the grounding portion passes through the first slot, the first through hole, the first hole and the first recessed hole are in air communication with each other and are aligned along a common axis, and the mounting member passes through the first through hole, the first hole and the first recessed hole to fix the antenna on the carrier frame.

8. The electronic device of claim 1, wherein the carrier frame comprises a bottom plate and a side edge, the side edge is on a periphery of the bottom plate to form an accommodating portion with the bottom plate, the first slot and the second slot are on the side edge.

9. The electronic device of claim 3, wherein the carrier frame comprises a bottom plate and a side edge, and the side edge is on a periphery of the bottom plate to form an accommodating portion with the bottom plate, the first slot and the second slot are on the side edge.

10. The electronic device of claim 1, wherein the outer frame is manufactured by Computer Numerical Control process and the carrier frame is manufactured by metal stamping process.

* * * * *